US009098104B2

(12) United States Patent
Navas et al.

(10) Patent No.: US 9,098,104 B2
(45) Date of Patent: Aug. 4, 2015

(54) LOW DROP OUT VOLTAGE REGULATOR

(71) Applicants: Ramon Tortosa Navas, Valencia (ES); Enrique Company Bosch, Valencia (ES); Santiago Iriarte, Valencia (ES)

(72) Inventors: Ramon Tortosa Navas, Valencia (ES); Enrique Company Bosch, Valencia (ES); Santiago Iriarte, Valencia (ES)

(73) Assignee: ANALOG DEVICES GLOBAL, Hamilton (BM)

( * ) Notice: Subject to any disclaimer, the term of this patent is extended or adjusted under 35 U.S.C. 154(b) by 182 days.

(21) Appl. No.: 13/788,917

(22) Filed: Mar. 7, 2013

(65) Prior Publication Data

US 2014/0253067 A1 Sep. 11, 2014

(51) Int. Cl.
*G05F 1/40* (2006.01)
*G05F 1/575* (2006.01)

(52) U.S. Cl.
CPC ..... *G05F 1/575* (2013.01)

(58) Field of Classification Search
CPC ..... G05F 1/30; G05F 1/575
USPC ..... 323/222, 271, 273, 277, 280, 282–290, 323/311–315; 327/91, 94–96, 143, 513, 327/538, 539
See application file for complete search history.

(56) References Cited

U.S. PATENT DOCUMENTS

| | | | | |
|---|---|---|---|---|
| 4,144,527 | A * | 3/1979 | Butler et al. | 341/136 |
| 4,618,814 | A * | 10/1986 | Kato et al. | 323/280 |
| 6,420,857 | B2 * | 7/2002 | Fukui | 323/280 |
| 6,570,411 | B1 * | 5/2003 | Bardsley et al. | 327/94 |
| 7,088,082 | B2 * | 8/2006 | Jung | 323/275 |
| 7,173,402 | B2 * | 2/2007 | Chen et al. | 323/280 |
| 7,589,507 | B2 * | 9/2009 | Mandal | 323/273 |
| 7,902,801 | B2 * | 3/2011 | Mandal | 323/273 |
| 7,944,288 | B2 * | 5/2011 | Ummelmann | 330/9 |
| 8,576,002 | B2 * | 11/2013 | Rajasekhar | 330/9 |

* cited by examiner

*Primary Examiner* — Rajnikant Patel
(74) *Attorney, Agent, or Firm* — Kenyon & Kenyon LLP

(57) ABSTRACT

A low drop out voltage regulator comprising: a transistor having an input node, an output node, and a control node; a differential amplifier having an output connected to the control node of the transistor and having a first input node; and a feedback capacitor connected between the output node of the transistor and the first input of the differential amplifier, wherein a voltage at the output of the transistor is dependent on a charge across the feedback capacitor.

20 Claims, 6 Drawing Sheets

LOW DROP OUT VOLTAGE REGULATOR

BACKGROUND

Voltage regulators are typically used in electronic circuits when it is desired to have a particularly stable input voltage for a particular electronic element or component. In particular, voltage regulators are typically used when it is desired to prevent a voltage input from rising above a particular level. A low-drop out, or LDO, regulator is a DC linear voltage regulator that can operate with a very small input/output differential voltage. The advantages of a low-drop out voltage include a lower minimum operating voltage, higher efficiency operation and lower heat dissipation. A traditional LDO regulator includes a transistor, typically a field effect transistor (FET) and a differential amplifier with a resistor divider in the feedback path. One input of the differential amplifier therefore monitors the fraction of the output determined by the resistor divider ratio, whilst the second input to the differential amplifier is from a stable voltage reference, such as a bandgap reference. If the output voltage rises too high relative to the reference voltage, then the drive to the transistor changes to maintain a constant output voltage.

However, the traditional LDO regulator structure using a resister divider as mentioned above, suffers from a number of drawbacks, particularly when implemented in integrated circuits. To limit the current drawn by the regulator then a large value of resister is needed in the feedback path. This large value resister requires a large silicon area on the integrated circuit. The large resister also creates an extra, undesired, pole in the feedback path, reduces the feedback factor and is a major contributor of noise in the system.

SUMMARY OF THE INVENTION

According to embodiments of the present invention there is provided a low-drop out voltage regulator comprising a transistor having an input node, an output node, and a control node, a differential amplifier having an output connected to the control node of the transistor and having a first input node, and a capacitor connected between the output node of the transistor and the first input of the differential amplifier, wherein a voltage at the output of the transistor is dependant on a charge across the capacitor.

The low drop out voltage regulator may further comprise a switched capacitor divider network having an input connected to the output node of the transistor and an output connected to feedback capacitor.

The switched capacitor divider network may be periodically operational to apply charge to the feedback capacitor.

The switched capacitor divider network may include first and second capacitors connected in parallel and a plurality of controllable switches.

During a first phase of operation of the switched capacitor divider network the plurality of switches may be configured to couple the first capacitor between the output node of the transistor and ground, and to couple both terminals of the second capacitor to ground.

During a second phase of operation of the switched capacitor divider network the plurality of switches may be configured to couple the first capacitor in parallel with the second capacitor.

During a third phase of operation of the switched capacitor divider network the plurality of switches may be configured to couple the first and second capacitors to the feedback capacitor.

BRIEF DESCRIPTION OF THE DRAWINGS

Embodiments of the present invention are described below, by way of non-limiting illustrative example only, with reference to the accompanying figures, of which.

DETAILED DESCRIPTION OF EMBODIMENTS OF THE INVENTION

Figure 1:
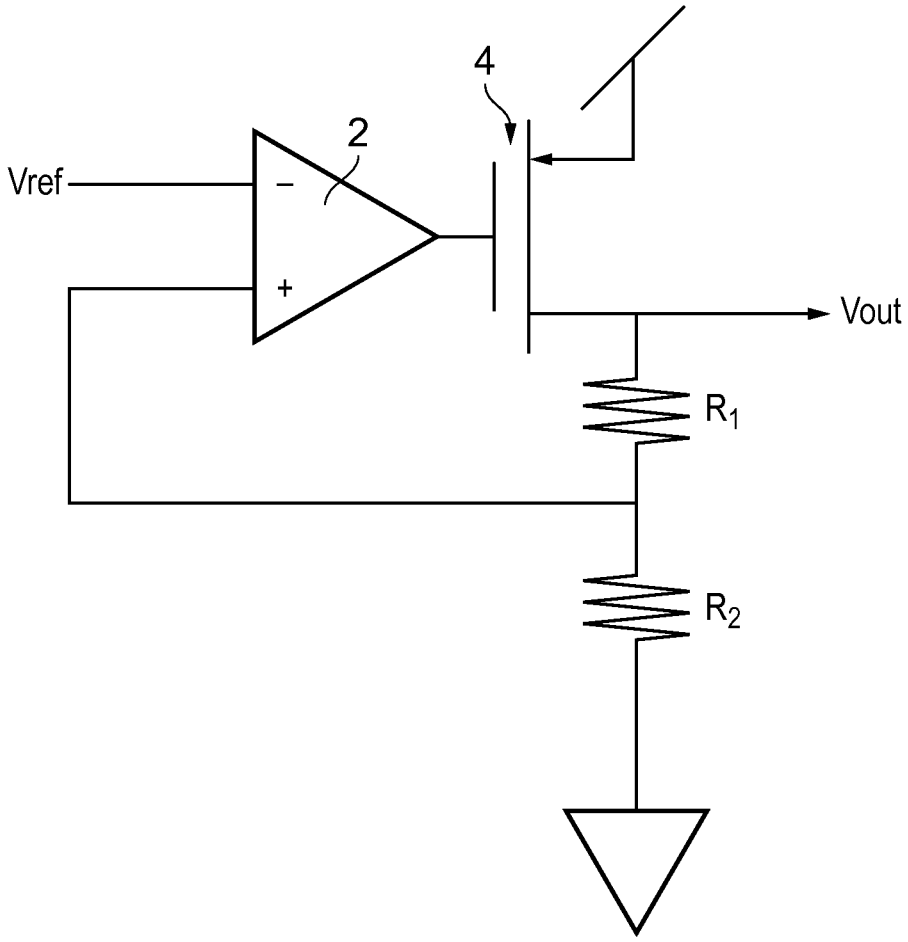
FIG. 1 schematically illustrated a low-drop out voltage regulator with a resister divider in the feedback path.

FIG. 1 schematically illustrates the components and layout of a traditional low power low-drop out voltage regulator using a resistor divider in the feedback path. A differential amplifier 2 has a first input connected to a reference voltage Vref, such as a bandgap reference voltage. The output of the differential amplifier is connected to the gate (control node) of a field effect transistor (FET) 4. A further terminal (input node) of the FET is connected to a supply voltage, whilst the second terminal (output node) of the FET provides a regulated output voltage Vout. Also connected to the output node of the FET is the first terminal of a resister divider network R1, R2, the other terminal of the resister divider network being connected to ground. A second input terminal of the differential amplifier 2 is connected to a mid point of the resister divider network. Consequently, for the circuit shown in FIG. 1, the output voltage is given as $$Vout = \left(1 + \frac{R2}{R1}\right) \times Vref$$

An increase in the output voltage Vout relative to the reference voltage Vref causes the gate of the FET to be driven so as to maintain a constant output voltage. For low power integrated circuit applications it is desirable to minimise the total current drawn by the voltage regulator as far as possible. A typical current budget for the voltage regulator may be 100 na, with a maximum of 20 na through the resistor network being desirable. If the desired output voltage Vout is 1.2V then the total resistance of the resistor network, R1+R2 in the circuit configuration illustrated, will equal 16M OHMs. The silicon area required to implement a resistor divider network of this value will be of the order of 4000 microns$^2$. As previously noted, in addition to the large silicon area required to implement the resistor divider network, the resistor creates an extra undesirable pole in the feedback path and reduces the feedback factor. Noise in the system is also amplified by the resistor divider division factor, and the resistors are a source of noise.

Figure 2:
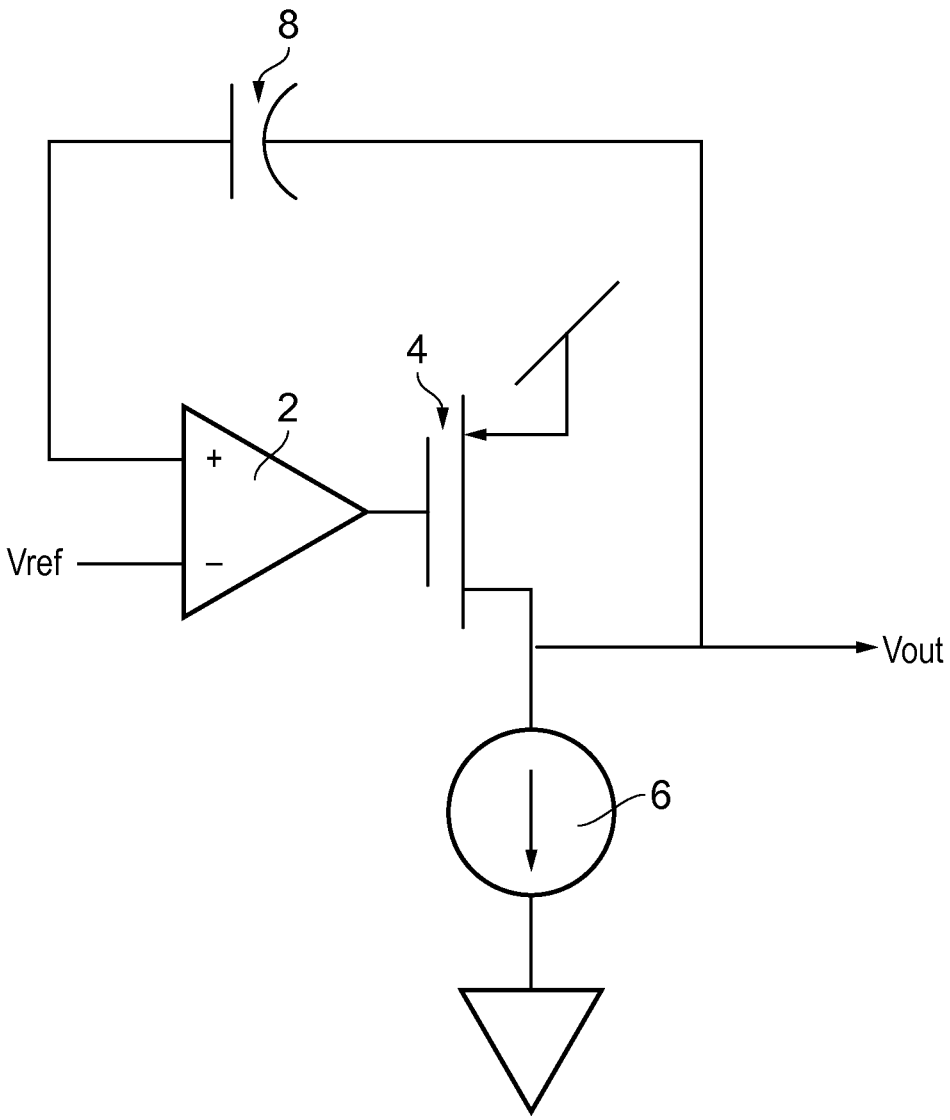
FIG. 2 schematically illustrates a low-drop out voltage regulator according to an embodiment of the present invention.

FIG. 2 illustrates a low power low-drop out voltage regulator according to an embodiment of the present invention. As with traditional circuit arrangement illustrated in FIG. 1, a differential amplifier 2 has a first terminal connected to a voltage reference Vref and an output connected to the gate (control node) of a field effect transistor 4. A first input terminal of the field effect transistor is again connected to a supply voltage, with the other terminal of the FET providing the output voltage node. In place of the resistor divider network of the traditional LDO arrangement shown in FIG. 1, the output node of the FET is now connected to ground via a constant current source 6. A capacitor 8 provides a feedback loop between the output node of the field effect transistor 4 and the second input terminal of the differential amplifier. It will be appreciated that in other embodiments alternative transistors may be used in place of an FET, such as a Bipolar Junction Transistor.

The feedback capacitor 8 and differential amplifier 2 form an integrator circuit. Under steady conditions a pre-defined desired charge is maintained across the capacitor 8 such that the output of the differential amplifier 2 drives the control node of the field effect transistor so as to maintain a constant outlook voltage Vout. A change in the output voltage Vout effectively alters the charge and voltage across the feedback capacitor 8 which in turn will cause the output of the differential amplifier to change and therefore moderate the operation of the field effect transistor so as to return the output voltage to the desired value.

Figure 3:
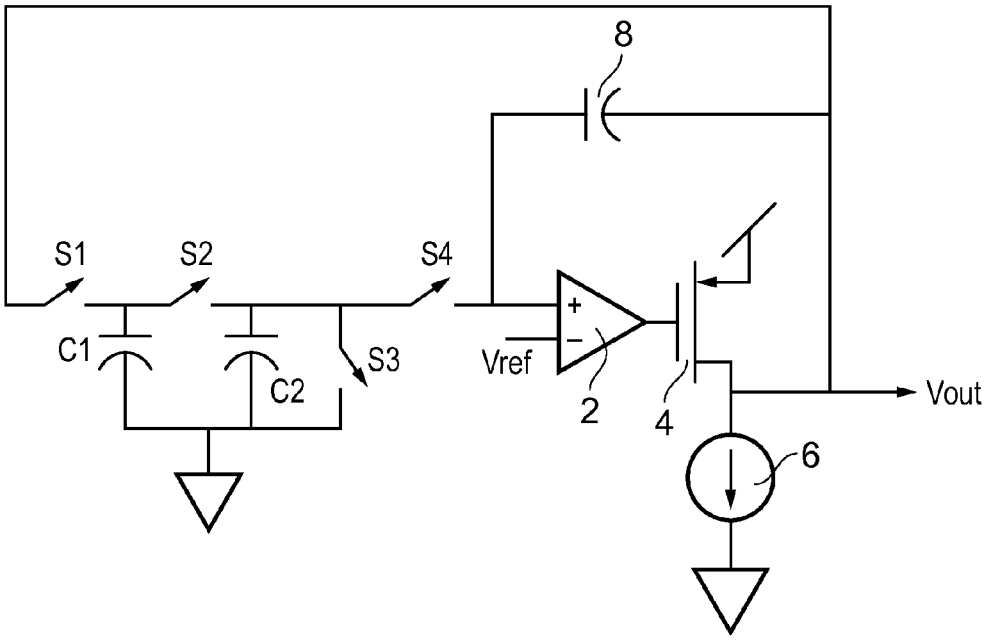
FIG. 3 schematically illustrates the LDO regulator of FIG. 2 in combination with a switched capacitor charging circuit.

FIG. 3 illustrates the voltage regulator of FIG. 2 in combination with a switched capacitor divider network that enables the feedback capacitor 8 of the voltage regulator circuit to be charged to the initial desired value and also to compensate for any charge leakage from the feedback capacitor during subsequent operation. The switched capacitor divider network includes three controllable switches S1, S2 and S4 connected in series between the output node of the field effect transistor 4 and the same input terminal of the differential amplifier 2 to which the feedback capacitor 8 is connected to. A first capacitor C1 has a first terminal connected between switches S1 and S2 and a second terminal connected to ground. A second capacitor C2 has a first terminal connected between switches S2 and S4 and a second terminal also connected to ground. The parallel connected capacitor C1 and C2 therefore form a capacitor voltage divider. A fourth switch S3 is connected in parallel with the second capacitor C2 between switches S2, S4 and ground.

Figure 4:
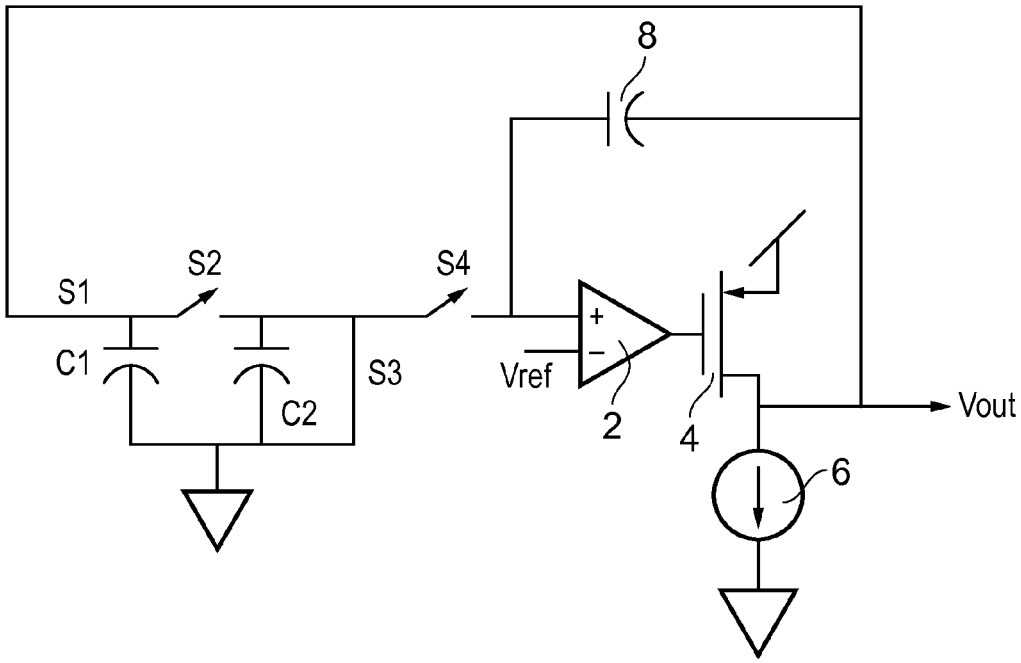
FIG. 4 illustrates the LDO regulator and charging circuit of FIG. 3 configured to sample the output of the LDO regulator.
Figure 5:
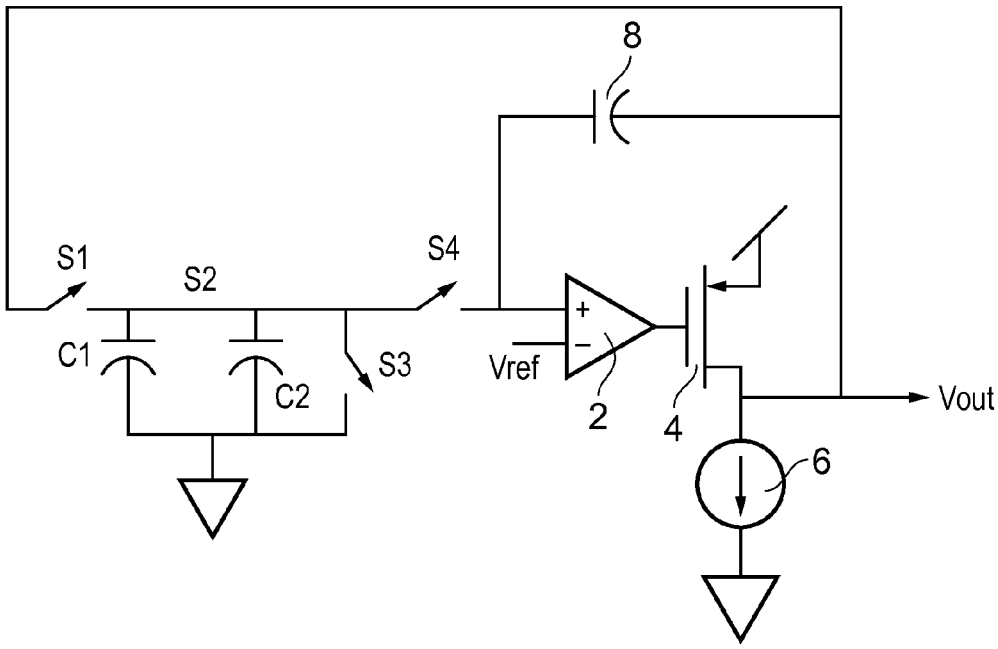
FIG. 5 illustrates the circuit of FIG. 4 configured to apply a voltage division to the sampled output voltage.
Figure 6:
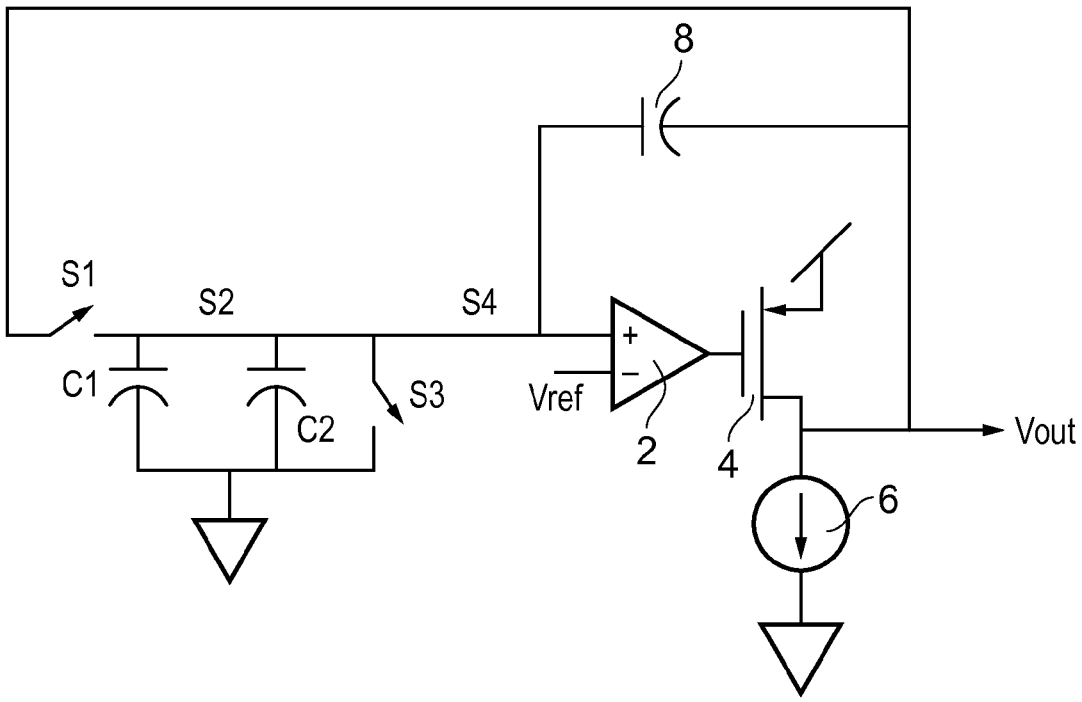
FIG. 6 illustrates the circuit of FIG. 3 configured to transfer a charge to the voltage regulator.

The switched capacitor divider network has three phases of operation which are illustrated respectively in FIGS. 4, 5 and 6. The operation of switches S1-S4 determines the phase of operation. FIG. 4 illustrates the circuit configuration during the first phase of operation during which the output voltage Vout is sampled. During this phase of operation switches S1 and S3 are closed. With first switch S1 closed the output voltage Vout from the voltage regulator is applied to the first capacitor C1 causing that capacitor to charge up to the output voltage Vout. Simultaneously, the closure of switch S3 connects both the terminals of the second capacitor C2 to ground, thereby discharging this capacitor. The second phase of operation is illustrated in FIG. 5, during which switches S1 and S3 are now opened, and switch S2 is closed. By closing switch S2 the charge previously applied to the first capacitor C1 from the output node of the voltage regulator is now shared between capacitors C1 and C2, thereby effectively dividing the voltage across the parallel capacitors. During the third phase of operation, illustrated in FIG. 6, the fourth switch S4 is additionally closed such that the charge applied across parallel capacitors C1 and C2 is transferred to the feedback capacitor 8 of the voltage regulator. If the output of voltage regulator Vout is at the desired value when sampled then there will be no difference between the charge transferred from the parallel capacitor C1 and C2 to the charge already present across feedback capacitor 8 and therefore there will be no effective change in voltage at the input node of the difference amplifier 2, such that the output voltage derived from the field effect transistor remains unchanged. However, if the sampled output voltage is not at the desired voltage level, then there will be a difference between the charge present across the feedback capacitor 8 and the charge transferred from parallel capacitor C1 and C2 such that the voltage at the input terminal to the differential amplifier will change, thereby causing the field effect transistor to be driven accordingly so as to maintain the desired output voltage.

In principle, the switched capacitor divider network should only be required to initially charge the feedback capacitor 8 to the correct value to achieve the desired regulator output voltage, with subsequent voltage regulation being achieved solely in dependence on the stored charge of the feedback capacitor. However, in reality it is very likely that there will be some leakage current from the feedback capacitor 8 that may be compensated for by periodically operating the switched capacitor divider network. The frequency of operation of the switched capacitor network will therefore vary. However, regardless of frequency of operation of the switched capacitor divider network, the output voltage from the voltage regulator is continuously regulated by virtue of the continuous feedback provided by feedback capacitor 8.

The use of a feedback capacitor in a low-drop out regulator as described above requires a much smaller silicon area than the previously used resistant divider arrangements. This is emphasised in that the switched capacitor divider capacitors need be of only very small capacitance values, further reducing the power requirement of the circuitry. Additionally, the feedback capacitor 8 does not introduce an extra pole in the feedback and consequently the bandwidth of the differential emphasis is fully utilised. The feedback capacitor also does not introduce additional noise, unlike the previously used feedback resistors. In use, in terms of load regulation, the described embodiments behave as a unity gain buffer with a defined offset. The advantage of this is that there is no reduction in the feedback factor (as previously caused by the resistor divider in previous implementations). This leads to better overall load regulation.

The invention claimed is:

1. A low drop out voltage regulator comprising:

a transistor having an input node, an output node, and a control node; a differential amplifier having an output connected to the control node of the transistor and having a first input node; and a feedback capacitor connected between the output node of the transistor and the first input of the differential amplifier, wherein a voltage at the output of the transistor is dependent on a charge across the feedback capacitor.

2. A low drop out voltage regulator according to claim 1, further comprising a switched capacitor divider network having an input connected to the output node of the transistor and an output connected to feedback capacitor.

3. A low drop out voltage regulator according to claim 2, wherein the switched capacitor divider network is periodically operational to apply charge to the feedback capacitor.

4. A low drop out voltage regulator according to claim 3, wherein the switched capacitor divider network includes first and second capacitors connected in parallel and a plurality of controllable switches.

5. A low drop out voltage regulator according to claim 4, wherein during a first phase of operation the plurality of switches are configured to couple the first capacitor between the output node of the transistor and ground, and to couple both terminals of the second capacitor to ground.

6. A low drop out voltage regulator according to claim 5, wherein during a second phase of operation the plurality of switches are configured to couple the first capacitor in parallel with the second capacitor.

7. A low drop out voltage regulator according to claim 6, wherein during a third phase of operation the plurality of switches are configured to couple the first and second capacitors to the feedback capacitor.

8. A low drop out voltage regulator comprising:

a transistor for generating an output of the low drop out voltage regulator; and an integrator coupled to the transistor, the integrator comprising:

a differential amplifier for controlling the operations of the transistor; and a feedback capacitor connected between the output and an input of the differential amplifier, wherein a voltage at the output is dependent on a charge across the feedback capacitor.

9. A low drop out voltage regulator according to claim 8, further comprising a switched capacitor divider network having its input connected to the output and its output connected to feedback capacitor.

10. A low drop out voltage regulator according to claim 9, wherein the switched capacitor divider network is periodically operational to apply charge to the feedback capacitor.

11. A low drop out voltage regulator according to claim 10, wherein the switched capacitor divider network includes first and second capacitors connected in parallel and a plurality of controllable switches.

12. A low drop out voltage regulator according to claim 11, wherein during a first phase of operation the plurality of switches are configured to couple the first capacitor between the output and ground, and to couple both terminals of the second capacitor to ground.

13. A low drop out voltage regulator according to claim 12, wherein during a second phase of operation the plurality of switches are configured to couple the first capacitor in parallel with the second capacitor.

14. A low drop out voltage regulator according to claim 13, wherein during a third phase of operation the plurality of switches are configured to couple the first and second capacitors to the feedback capacitor.

15. A method comprising:

amplifying a difference between a voltage from a stored charge across a feedback capacitor and a reference voltage to generate a control signal;

controlling a conductance of a transistor with the control signal to generate an output voltage; and based on the output voltage, adjusting the stored charge on the feedback capacitor so that the output voltage is dependent on the charge across the feedback capacitor.

16. The method according to claim 15, further comprising periodically applying a charge to the feedback capacitor via a switched capacitor divider network.

17. The method according to claim 16, wherein the switched capacitor divider network includes first and second capacitors connected in parallel and a plurality of controllable switches.

18. The method according to claim 17, wherein during a first phase of operation coupling the first capacitor between the output and ground, and coupling both terminals of the second capacitor to ground.

19. The method according to claim 18, wherein during a second phase of operation coupling the first capacitor in parallel with the second capacitor.

20. The method according to claim 19, wherein during a third phase of operation coupling the first and second capacitors to the feedback capacitor.

* * * * *